US007997035B2

(12) United States Patent
Weaver

(10) Patent No.: US 7,997,035 B2
(45) Date of Patent: Aug. 16, 2011

(54) WINDOW SCREEN USING WOVEN IMAGE

(76) Inventor: Lori Weaver, Covina, CA (US)

( * ) Notice: Subject to any disclaimer, the term of this patent is extended or adjusted under 35 U.S.C. 154(b) by 875 days.

(21) Appl. No.: 12/006,043

(22) Filed: Dec. 31, 2007

(65) Prior Publication Data

US 2009/0172586 A1 Jul. 2, 2009

(51) Int. Cl.
*E04B 1/12* (2006.01)

(52) U.S. Cl. ..... 52/63; 52/204.61; 52/311.2

(58) Field of Classification Search ..... 52/63, 204.59, 52/204.61, 311.2, 311.3, 656.7; 340/550; 160/89

See application file for complete search history.

(56) References Cited

U.S. PATENT DOCUMENTS 1,795,294 A * 3/1931 Collins ..... 427/282
3,051,935 A * 8/1962 Willson ..... 340/550
4,316,345 A 2/1982 Rivette et al.
4,644,684 A 2/1987 Verbeeck
5,443,563 A 8/1995 Hindel et al.
5,680,893 A 10/1997 Neer
5,881,525 A * 3/1999 Riegelman et al. ..... 52/656.7
6,123,117 A 9/2000 Borellini

* cited by examiner

*Primary Examiner* — Basil Katcheves
(74) *Attorney, Agent, or Firm* — Kirk A. Buhler; Buhler & Associates

(57) ABSTRACT

Improvements in a window screen are disclosed. The improvements include the use of a woven pattered window screen. The window screen design includes a woven non-geometric pattern to create a more visually appealing image when looking at and through the window screen. The woven screen material is held onto a base frame with an elastomeric bead. The screen can also be retained in a retractable roll where it can be withdrawn to cover a door, or as an awning. The woven image can include a variety of patterns and pattern variations including flowers, leaves, pictures, images and seasonal patterns.

9 Claims, 3 Drawing Sheets

WINDOW SCREEN USING WOVEN IMAGE

FIELD OF THE INVENTION

This invention relates to improvements window screen design. More particularly, the present window screen design includes a woven non-geometric pattern to create a more visually appealing image when looking at and through the window screen.

BACKGROUND OF THE INVENTION

Most window screens are fabricated into vertical and horizontal wire mesh. The screen prevents insects and bugs from entering the house through the open window. The screen is typically fabricated from metal fiberglass or synthetic fibers or wires. The window screen serves the purposes of allowing air to pass through the screen and keep bugs and insects. Other uses of these screens is to enclose patios or pool areas where there is a large mosquito population. The screens also provide some thermal and light reflection properties.

The screen material is typically stretched over an aluminum or similar frame structure. A special tool having a handle and a wheel allows the installer to press a cord into the frame where it captures and retains the screen. In the majority of installations, the intent is to provide a screen that is virtually invisible to the homeowner. The wire material and the density of the weave is selected based upon price, opening size, color and longevity. Some patents have been issued on screens where an image has been printed onto an existing screen or hand stitched into an existing screen. Still other patents have issued where the image was sublimated or glued onto the screed some exemplary examples of these patents are presented herein.

U.S. Pat. No. 6,123,117 issue Sep. 26, 2000 to Pio Borellini discloses a woven label with a transparent mesh fabric superposed in its image. This patent is for a semi transparent label with a woven image. The label is small in size, provides little or no air flow through the label and is not useful for screening a window.

U.S. Pat. No. 5,680,893 issued Oct. 28, 1997 to Dana L. Neer discloses a decorative privacy screen. The decorative screen is constructed from an open weave with a decorative base screen and a decorative pigmented coating that creates the pattern. While this screen includes a pattern, the pattern is created from a coating process that is bonded to the base screen.

U.S. Pat. No. 5,443,563 issued Aug. 22, 1995 to Josef Hindel et al., discloses roller blinds and a process for their manufacture. The process consists of screen printing an image onto the blind or screen. This is also essentially a two step operation where the color or pattern is screened or added to the base screen or blind.

What is needed is a decorative screen where the screen include a non-geometric woven patter that will create privacy, air flow, block bug intrusion and have a pleasing visual pattern that makes the home more attractive. The proposed window screen provides this solution with a pattern that is woven into the screen in a single operation making the pattern a permanent part of the screen.

BRIEF SUMMARY OF THE INVENTION

It is an object of the window screen using a woven pattern for the pattern to be woven into the screen where it provides a permanent image. The permanent image will retain its appearance for the life of the screen. The screen is also not degraded from the woven image and thereby the screen is stronger.

It is an object of the window screen using a woven pattern for the pattern to be a non-geometric pattern. The non-geometric pattern allows the screen to have a more pleasing appearance where it brings additional character to the window and the house.

It is an object of the window screen using a woven pattern to provide a pattern that provides a different appearance on both sides of the screen. The different pattern is accomplished by weaving the screen with different density of patterns in the front and back of the screen. The different densities can be woven with different colored material to provide the slightly different patterns when viewed from the inside or outside of the screen.

It is another object of the window screen using a woven pattern to be fabricated from a number of different materials. The materials can be selected based upon the desired light reflection, longevity and user's preference. A variety of different materials or colored individual strands of material can be used to provide for a colored image. The denser areas of the weave provide some depth to the woven pattern.

It is still another object of the window screen using a woven pattern is configured in a finite repeating pattern. The pattern can repeat every few inches to every several feet to provide a larger landscape scene.

Various objects, features, aspects, and advantages of the present invention will become more apparent from the following detailed description of preferred embodiments of the invention, along with the accompanying drawings in which like numerals represent like components.

DETAILED DESCRIPTION

Figure 1:
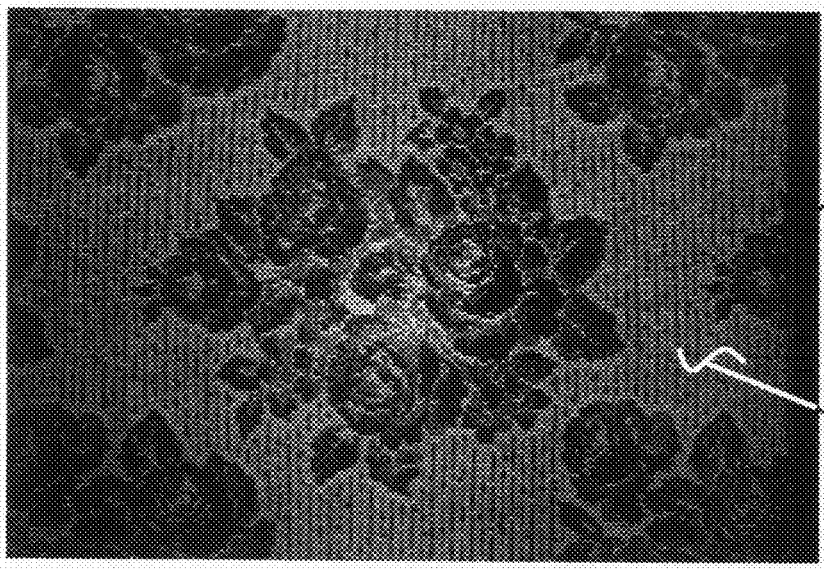
FIG. 1 shows an image of a flowered window screen pattern.

FIG. 1 shows an image of a flowered 20 window screen pattern. The decorative window screen 10 shows a portion of the rigid frame structure 30 along one side of the screen. This image shows a flowered image in the center with a screened area around the central flower image. A series of flower images exist around the central flower image. The pattern of the flowers repeats, and if the screen was fabricated for a larger window the repeating pattern would be more evident. Some examples of repeating patterns is shown and described in more detail in FIGS. 4 and 6. The image is not a geometric pattern that is most commonly found on window coverings.

Figure 2:
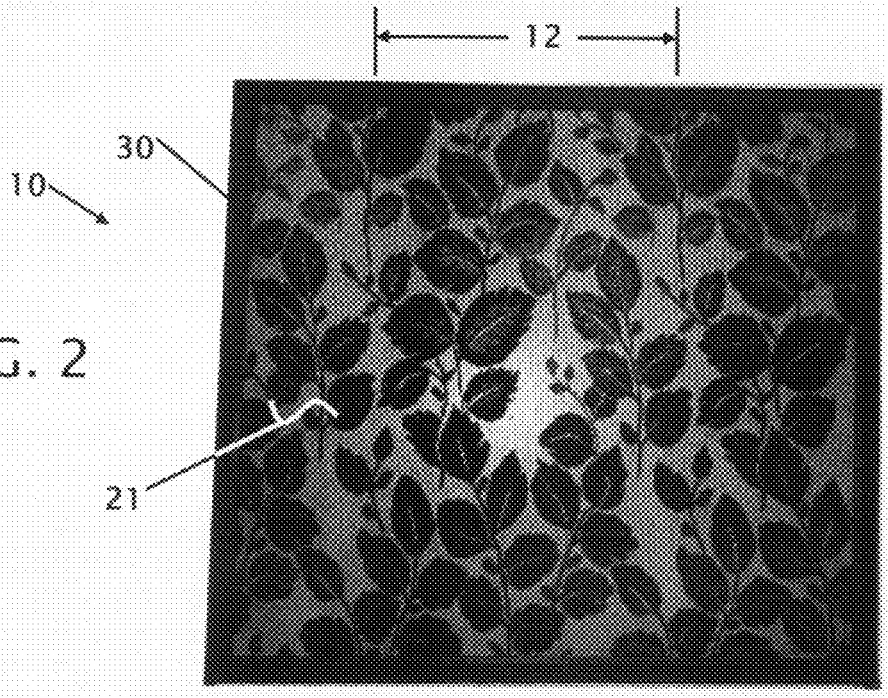
FIG. 2 shows an image of a leave window screen pattern.

FIG. 2 shows an image of a leave 21 window screen pattern. The decorative window screen 10 is shown with the rigid frame 30 extending entirely around the decorative window screen. The leave or vine pattern is repeats at an interval 12. It is contemplated that the image repeats every several inches to every several feet. The interval that the pattern repeats is based upon the complexity of the pattern and the desired image. The repeating pattern is similar to the repeating pattern found in wall paper rolls. The rigid frame structure 30 has a recessed groove for retaining the decorative screen. An elastomeric spline is placed at least partially around the decorative screen to hold the decorative pattern within the rigid frame structure. The installation of the spline within the window frame is shown and described in more detail in FIG. 6.

Figure 3:
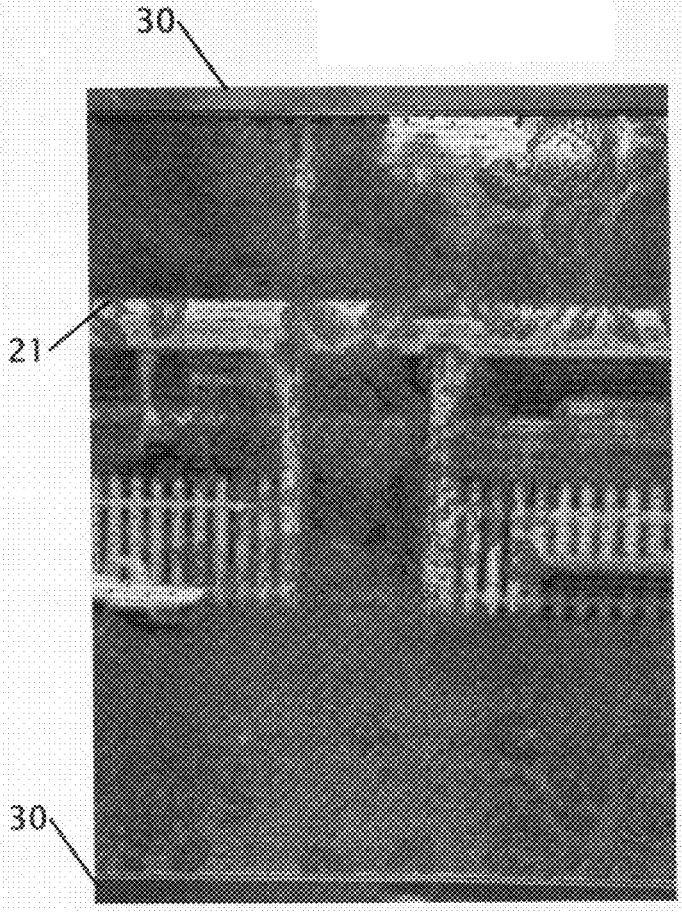
FIG. 3 shows a view looking through the leave window screen from FIG. 2.

FIG. 3 shows a view looking through the leave window screen 21 from FIG. 2. When looking through the screen 10 both the image of the leave pattern 21 and the image of objects located outside the window are visible. The open decorative screen provides filtering or reflection of light. The top and bottom portions of the rigid frame 30 are visible in this figure. The frame is typically square of rectangular in configuration and is used to at least partially cover a window or door opening.

Figure 4:
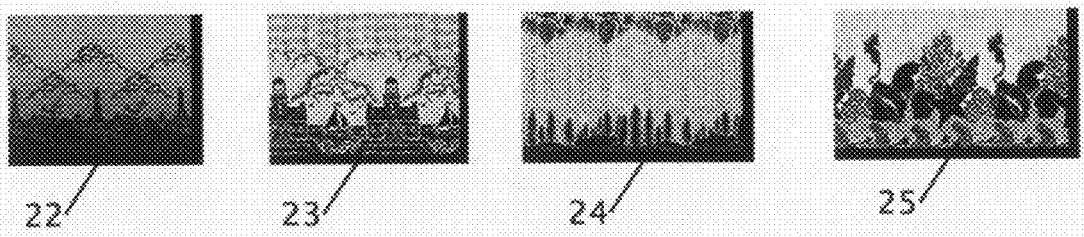
FIG. 4 show various contemplated window screen patterns.

FIG. 4 show various contemplated window screen patterns. The image with item 22 shows a city and mountain scene. In this screen image there is an obvious orientation for the screen. The bottom of this image provides a nearly complete blockage of the screen to provide a darker image. It is contemplated that the non-geometric image is woven with varying degrees of density to provide a gray scale image. The image with item 23 is an ocean, sea or bay scene. The various densities of the non-geometric weaving creates waves in the water and clouds in the sky.

The image with item 24 is a forest scene. In this pattern a different repeating pattern is shown on the top and the bottom of the screen. A pattern with a distinct upper and lower image would require window screen that is fabricated with a predetermined window size. It is contemplated that the woven image screen is fabricated in various standard heights. The upper and lower dark areas can be extended to make the screen more universal to cover several different size window opening with the same height screen pattern. Image 25 is an ocean, beach or water image showing sand, waves, shells, sea horses and coral. While several non-geometric patterns and images have been shown and described it is contemplated that the non-geometric pattern include but not be limited to floral, landscape, seascape, seasonal or celebration patterns. It is further contemplated that image that is woven with the base screen can be woven with fiber that are different colors or widths, and the image has different levels of light reflection and transmission properties. The fibers used in the base screen and the color of the fibers used in the image can be the same or different. The images shown will appear the same when the screen is viewed from both sides of the screen, it is contemplated that the image woven with the screen could provide a different appearance based upon the side of the screen being viewed.

Figure 5:
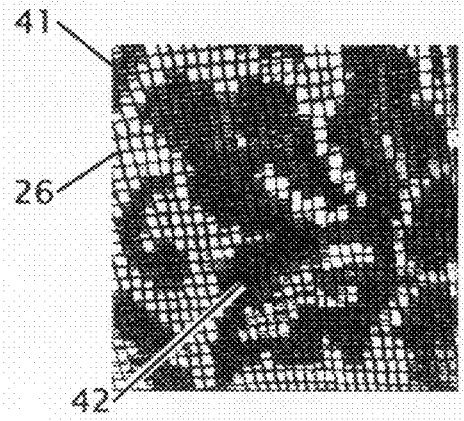
FIG. 5 shows a detailed view of a section of window screen.

FIG. 5 shows a detailed view of a section of window screen. The screen is an open mesh woven base screen 26 having both vertical and horizontal interwoven fibers woven to provide air passage while further providing a barrier for insects. While vertical and horizontal weaving is the preferred embodiment, other weaving directions are contemplated that will accomplish similar performance and appearance. While the base screen 26 is being woven a non-geometric image is interwoven into the base screen to create the decorative screen. Only a portion of the screen is shown in this figure to provide a more detailed image of the screen.

Various fibers are contemplated to create the base screen 26 and or the decorative image. The contemplated fibers include but are not limited to nylon, polyester, metal, aluminum, copper, brass, bronze, stainless steel, galvanized steel, plastic, silk, cotton and fiberglass. In some version the screen is coated with vinyl to bond the woven fibers and provide a consistent gloss, color or appearance. This section of screen shows three different levels of light transmission where the woven base screen 26 provides the most light transmission, a heavier weave 41 blocks more light and area 42 provides even more light blocking. While only three levels are shown in this image it is contemplated that many more levels of image weaving will create numerous levels of chromatic light transmission.

Figure 6:
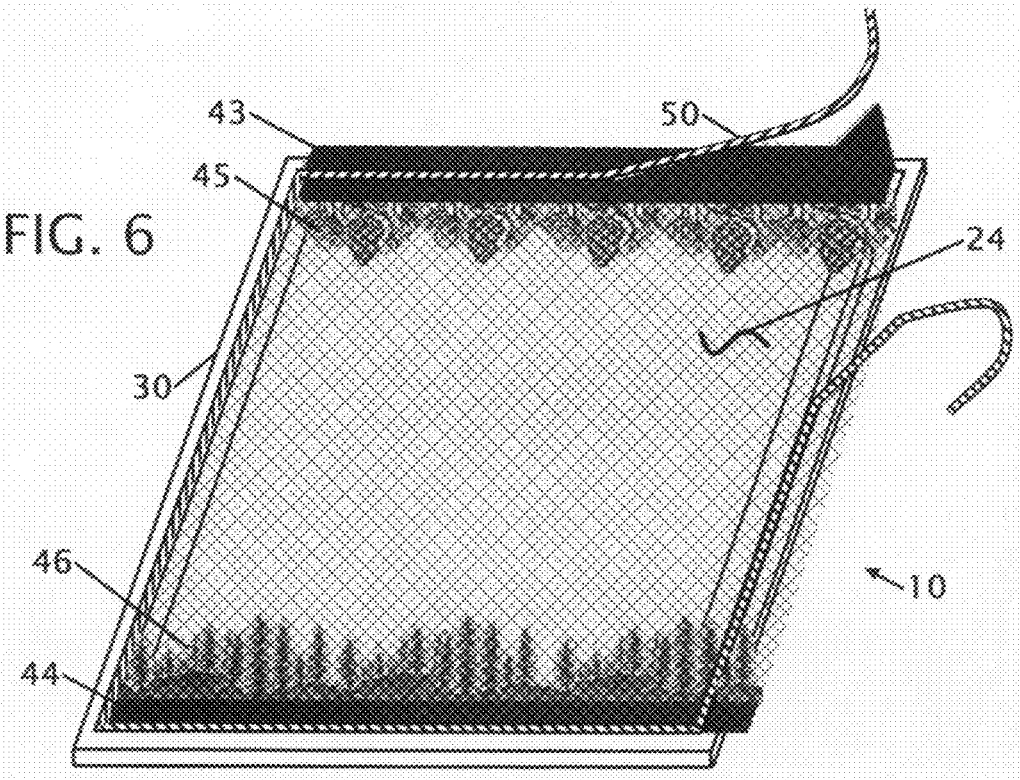
FIG. 6 shows an image of the window screen with a woven pattern being installed onto a window frame.

FIG. 6 shows an image of the window screen 24 with a woven pattern being installed onto a window frame 30 to create the decorative window screen 10. The decorative window screen 10 material is a semi-rigid decorative screen allowing it to be rolled out onto the frame 30. The installation of the decorative screen 24 on the frame 30 is similar to the methods used to replace a screen on a standard window screen frame. The rigid frame structure 30 has a recessed groove for retaining the decorative screen. An elastomeric spline 50 is placed at least partially around the decorative screen to hold the decorative pattern within the rigid frame structure. The spline 50 is pushed or rolled into the recess using a wheeled tool to retain the screen 24 within the frame 30.

The decorative window screen in this figure shows a different image on the upper 45 and lower 46 portions of the decorative window screen to provide an specific orientation for the decorative window screen when the window screen is placed over a window. A heavy woven upper 43 and lower 44 area blocks out the end sections of the screen to account for slight misalignment of the decorative screen when it is being placed onto the frame 30.

Thus, specific embodiments of a window screen using a woven pattern have been disclosed. It should be apparent, however, to those skilled in the art that many more modifications besides those described are possible without departing from the inventive concepts herein. The inventive subject matter, therefore, is not to be restricted except in the spirit of the appended claims.

What is claimed is:

1. A decorative window screen comprising:

an open mesh woven base screen having both vertical and horizontal interwoven fibers woven to provide air passage while further providing a barrier for insects;

the woven base screen further comprises a non-geometric image that is interwoven into the base screen as the base screen is being woven to create a decorative screen;

a rigid frame structure having a recessed groove for retaining the decorative screen;

an elastomeric spline is placed at least partially around the decorative screen to hold the decorative pattern within the rigid frame structure and said non-geometric image provides more than one level of woven density to create numerous levels of chromatic light transmission.

2. The decorative window screen according to claim 1 wherein the fibers are woven from nylon, polyester, metal, aluminum, copper, brass, bronze, stainless steel, galvanized steel, plastic, silk, cotton and fiberglass.

3. The decorative window screen according to claim 2 wherein the vertical and horizontal interwoven fibers are different colors than the interwoven non-geometric image.

4. The decorative window screen according to claim 1 wherein the non-geometric pattern is floral, landscape, seascape, seasonal or celebration.

5. The decorative window screen according to claim 1 wherein the woven fibers of the screen and the non-geometric image are coated with vinyl to bond the woven fibers.

6. The decorative window screen according to claim 1 wherein the non-geometric image repeats at an interval of between four and 48 inches.

7. The decorative window screen according to claim 1 wherein the open decorative screen provides filtering or reflection of light.

8. The decorative window screen according to claim 1 wherein the color of the fibers used in the open mesh woven base screen and the color of the fibers used in the non-geometric image are different.

9. The decorative window screen according to claim 1 wherein the rigid frame is rectangular in configuration and is used to at least partially cover a window or door opening.

* * * * *